US010520248B2

(12) United States Patent
Arens et al.

(10) Patent No.: US 10,520,248 B2
(45) Date of Patent: Dec. 31, 2019

(54) HOUSEHOLD DEVICE HAVING AN INPUT MEANS LOCKING DEVICE

(71) Applicant: BSH HAUSGERAETE GMBH, Munich (DE)

(72) Inventors: Thomas Arens, Regensburg (DE); Christoph Hauzeneder, Sonnen (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/507,284

(22) PCT Filed: Aug. 19, 2015

(86) PCT No.: PCT/EP2015/069005
§ 371 (c)(1),
(2) Date: Feb. 28, 2017

(87) PCT Pub. No.: WO2016/030241
PCT Pub. Date: Mar. 3, 2016

(65) Prior Publication Data

US 2017/0284734 A1 Oct. 5, 2017

(30) Foreign Application Priority Data

Aug. 29, 2014 (DE) ..... 10 2014 217 288

(51) Int. Cl.
*F25D 29/00* (2006.01)
*F24C 7/08* (2006.01)
(Continued)

(52) U.S. Cl.
CPC ..... *F25D 29/006* (2013.01); *F24C 7/083* (2013.01); *F24C 15/2021* (2013.01);
(Continued)

(58) Field of Classification Search
CPC ..... F24F 11/30; F24F 11/56; F24F 2110/10; G05B 2219/2614
(Continued)

(56) References Cited

U.S. PATENT DOCUMENTS 5,698,826 A * 12/1997 Cracraft ..... H01H 13/70 200/310
6,483,695 B1 11/2002 Hartstein
(Continued)

FOREIGN PATENT DOCUMENTS

DE 102011010615 A1 8/2012
JP 2014044022 A 3/2014
WO 9750045 A1 12/1997

*Primary Examiner* — Emily C Terrell
(74) *Attorney, Agent, or Firm* — Laurence A. Greenberg; Werner H. Stemer; Ralph E. Locher

(57) ABSTRACT

A household device, in particular a refrigeration device, includes an electronic control device configured to control at least one function of the household device, an input device connected to the control device, having at least one input and being configured to supply an assigned control signal to the control device, based on a manual actuation of the at least one input. An input locking device, in its locked state, is configured to prevent controlling of the function of the household device, despite the at least one input being actuated, and in its unlocked state, is configured to permit controlling of the function of the household device when the at least one input is actuated. The input locking device is configured and/or constructed for shifting the input locking device into the locked state, after the at least one input has not been actuated over a predefined time period.

21 Claims, 3 Drawing Sheets

(51) Int. Cl.
*F24C 15/20* (2006.01)
*F25D 23/02* (2006.01)

(52) U.S. Cl.
CPC ..... *F25D 23/028* (2013.01); *F25D 29/00* (2013.01); *F25D 2400/361* (2013.01); *F25D 2600/02* (2013.01); *F25D 2700/02* (2013.01)

(58) Field of Classification Search
USPC ..... 340/5.31, 5.38
See application file for complete search history.

(56) References Cited

U.S. PATENT DOCUMENTS

| | | | | |
|---|---|---|---|---|
| 6,802,186 | B2 * | 10/2004 | Holmes | F25D 11/02 62/187 |
| 8,495,885 | B2 | 7/2013 | Cooper et al. | |
| 2001/0054291 | A1 * | 12/2001 | Roh | F25D 29/00 62/126 |
| 2008/0295033 | A1 | 11/2008 | Lee et al. | |
| 2009/0158766 | A1 * | 6/2009 | Cooper | F25D 29/006 62/389 |
| 2011/0062143 | A1 * | 3/2011 | Satanek | F24C 7/085 219/489 |
| 2012/0260683 | A1 * | 10/2012 | Cheon | F25D 29/00 62/125 |

* cited by examiner

HOUSEHOLD DEVICE HAVING AN INPUT MEANS LOCKING DEVICE

BACKGROUND OF THE INVENTION

Field of the Invention

The invention relates to a household device, comprising an electronic control device, which is designed to control at least one function of the household device; an input device connected to the control device, which comprises at least one input means and which is designed, on the basis of a manual actuation of the at least one input means, to supply an assigned control signal to the control device, and an input means locking device, which, in its locked state, is designed to prevent a controlling of the function of the household device despite the at least one input means being actuated and, in its unlocked state, is designed to permit a controlling of the function of the household device when the at least one input means is being actuated.

DE 10 2011 010 615 A1 describes a household device, especially a refrigerator and/or freezer device, with at least one control element to be actuated by a user, wherein the control element is designed such that a function of the household device will be activated as a result of an actuation of the control element by the user, wherein the device has at least one detection unit, which is designed such that the duration of the actuation during which the user is actuating the control element is able to be established by means of the detection unit and that the household device furthermore has at least one comparator unit, which is designed such that it compares the duration of the actuation with an upper limit value and only activates the function of the household device or only permits its activation if the duration of the actuation lies below the upper limit value or corresponds to said value.

SUMMARY OF THE INVENTION

The object of the invention is to create a household device with an input device that can be operated in a safe way.

The object of the invention is achieved by a household device having an electronic control device, which is designed to control at least one function of the household device; an input device connected to the control device, which comprises at least one input means and which is designed, on the basis of a manual actuation of the at least one input means, to supply an assigned control signal to the control device, and an input means locking device, which, in its locked state, is designed to prevent a controlling of the function of the household device despite the at least one input means being actuated and, in its unlocked state, is designed to permit a controlling of the function of the household device when the at least one input means is being actuated, wherein the input means locking device is designed and/or intended, in the absence of an actuation of the at least one input means over a predetermined period of time, to put the input means locking device into the locked state.

The invention describes, sometimes expressed in different terms, an automatic protection of a control section, i.e. an input device, from an unintentional change of the device settings by the user of the household device. A microcontroller-based method can be used for this purpose, which makes it possible to automatically lock the input means, such as buttons and/or touch panels of a control element, when applied to the case of refrigeration devices in particular, after a predefined, i.e. predetermined, time and protect them against unintentional user entries. After the activation of the locking of the control elements, although the user can still actuate all control elements, the entries of the user no longer lead however to a change in the device settings defined by the user. The control elements can be designed as capacitive touch buttons, but also as mechanical buttons or comparable control elements. If the user actuates any given switching element of the control section after the automatic locking of the control section, the actuation of the button can be confirmed to the user by an acoustic signal for example. By an optical signal, such as the flashing of the LED of the display for the button locking, it can also be displayed to the user for example, and to this extent an indication provided as to which button the user must actuate to unlock the control section. In order to avoid the control section being released accidentally, a predefined minimum actuation duration of the control element can be configured. With the inventive solutions users themselves no longer necessarily have to take care of protecting the control section from unwanted or unintentional user entries. Depending on the last actuation of a control element input will be blocked after the predefined time.

The input device can have an additional input means, especially an unlocking means to be actuated manually, which is designed and/or intended, when it is actuated, to put the input means locking device into the unlocked state.

The additional input means, especially the unlocking means to be actuated manually, can be designed and/or controlled in its basic function to switch on or to switch off the household device, in particular an electrical mains supply of the household device can be connected or disconnected with this means. The additional input means, especially the unlocking means to be actuated manually, can however also be designed and/or controlled to put the household device into a standby mode or to activate it from a standby mode, so that the household device is ready for operation.

The additional input means, especially the unlocking means to be actuated manually, can be designed and/or intended only to put the input means locking device into the unlocked state after an ongoing actuation extending beyond the minimum period of time.

If the input means locking device is already in the unlocked state, the additional input means, especially the unlocking means to be actuated manually, can carry out its intended function, i.e. disconnect the household device from the electrical mains supply or put it into standby mode for example, as soon as the additional input means, especially the unlocking means to be actuated manually, is just actuated for a short time. If the input means locking device is in the locked state however, then in this embodiment variant of the invention the additional input means, especially the unlocking means to be actuated manually, must continue to be pressed for longer than the minimum duration amounts to. The input means locking device is then put into the unlocked state. If in this case the input means locking device is put into the unlocked state, the control device can either be designed and/or intended so that the intended function is also carried out immediately therewith, i.e. for example the household device is disconnected from the mains power or is put into standby mode, or the control device can be designed and/or intended so that initially this function is not activated immediately, but a further actuation of the additional input means, especially of the unlocking means to be actuated manually, is necessary in order to carry out the intended function.

The control device can be designed and/or intended, during the ongoing actuation of the additional input means, especially of the unlocking means to be actuated manually, to output an acoustic and/or optical signal of a first type.

The acoustic signal of the first type can for example be a beep that sounds once or a number of times in succession. The optical signal of the first type can for example be a flashing of a lamp or of an LED.

The control device can be designed and/or intended, after the minimum duration has elapsed in which there has been an ongoing actuation of the additional input means, especially of the unlocking means to be actuated manually, to output an acoustic and/or optical signal of a second type that differs from the acoustic and/or optical signal of the first type.

The acoustic signal of the second type can for example be a beep that sounds once or a number of times in succession. The optical signal of the second type can for example be a flashing of a lamp or of an LED.

The additional input means, especially the unlocking means to be actuated manually, can be designed and/or intended, in the unlocked state of the input means locking device, to activate another function differing from the unlocking function. To this end the additional input means, especially the unlocking means to be actuated manually, can, as already mentioned, be designed and/or intended to put the household device into a standby mode or to activate it from the standby mode, so that the household device is ready for operation or for example is designed and/or controlled to switch the household device on or off, in particular an electrical mains supply of the household device can be connected or disconnected in this way.

The control device can be designed and/or intended, when the at least one input means is actuated in the locked state of the input means locking device, to output an acoustic and/or optical signal of a third type.

The acoustic signal of the third type can for example be a beep that sounds once or a number of times in succession. The optical signal of the third type can for example be a flashing of a lamp or of an LED.

The control device can be designed and/or intended, when the at least one input means is actuated in the locked state of the input means locking device, to output an acoustic or optical signal especially indicative of the additional input means, especially the unlocking means to be actuated manually.

The predetermined period of time can be a period of between 10 seconds and 50 seconds, especially of 30 seconds.

The input device can have at least one touch input device, can especially have a touch screen to which at least one touch input means is assigned.

The invention accordingly relates to a household device, especially a refrigeration device, a stove, a cooktop, an extractor hood, a dishwasher, a washing machine, a washer/dryer or a fully automatic coffee machine, having an inventive input device and an associated input means locking device, as described.

A concrete exemplary embodiment of a household device, especially of a refrigeration device, with an inventive input device and input means locking device, is described in greater detail in the description given below, which refers to the enclosed figures. Concrete features of this exemplary embodiment, regardless of the context in which they are mentioned, if necessary also considered individually or in combination, can represent general features of the invention.

DESCRIPTION OF THE INVENTION

Figure 1:
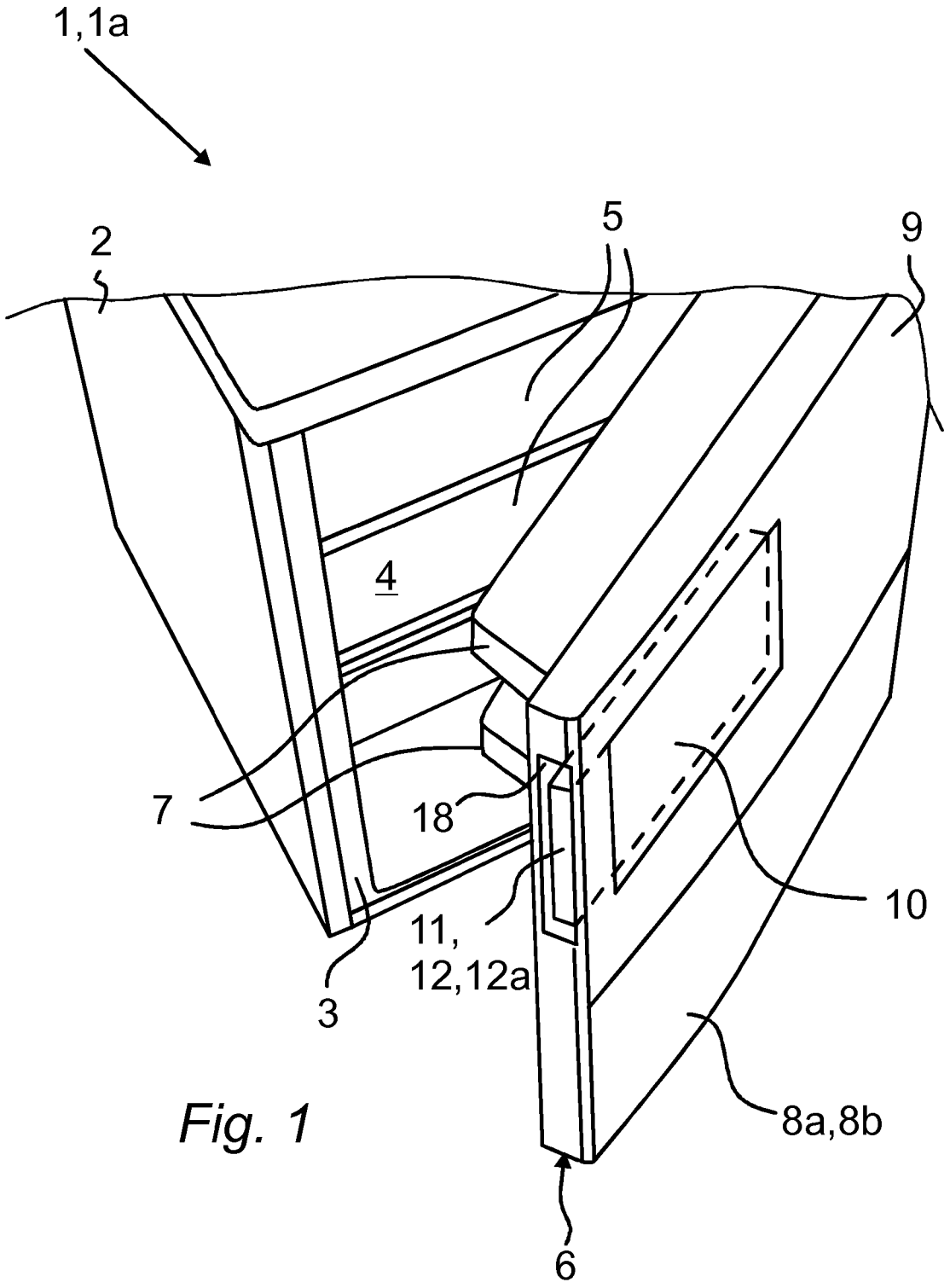
FIG. 1 shows a perspective diagram of a household device designed as a refrigeration device with a door leaf having the input device.

A household device 1 shown by way of example in FIG. 1 is embodied as a refrigeration device 1*a*. The refrigeration device 1*a* has a body 2. Arranged in the body 2 is a heat-insulating inner container 3. The inner container 3 delimits a storage space 4 for refrigerated goods, especially for foodstuffs. One or more shelves 5, especially glass shelves, for storage of foodstuffs, can be arranged in the inner container 3. A front-side access opening of the storage space 4 is able to be closed off by a door leaf 6. In the case of the present exemplary embodiment the door leaf 6 is supported pivotably around a vertical pivot axis in relation to the inner container 3. To this end the door leaf 6 can be hinged by hinge fittings not shown in any greater detail onto the body 2 or onto the inner container 3 for example. On an inner side of the door leaf 6 facing towards the storage space 4, as shown in FIG. 1, one or more door shelves 7 can be arranged. The door leaf 6 can optionally have a glass front 8*a* or a metal front 8*b* on its outer side. As an alternative or in addition the door leaf 6 can have a control panel 9 on its outer side. The control panel 9 can be made of a plastic, especially made of a transparent plastic, or can at least have a transparent window section 10. The transparent window section 10, in a specific form of embodiment, can just be formed solely by an area of the glass front 8*a*.

In the area of the transparent window section 10 the household device 1 or the refrigeration device 1*a* has an input device 11. The input device 11 is in particular arranged behind the control panel 9 or the glass front 8*a* or the metal front 8*b*. The input device 11 has at least one input means 12, which is designed, on the basis of a manual activation of the input means 12, to control a function of the household device 1. In the case of the present exemplary embodiment the at least one input means 12 will be embodied by a touch screen 12*a*.

In order to fasten a pre-installed input device 11 to the rear side of the glass front pane, i.e. to the glass front 8*a* or to the rear side of the glass door leaf so that it lies flat against them, a clamping device not shown in any greater detail can be provided, which is designed to spread itself out in a position pushed into a compartment 18, between the rear side of the pre-installed input device 11 and an inner wall of the compartment 18, so that the input device 11 will be pressed against the rear side of the glass front pane, i.e. the glass front 8*a*, or will be pressed onto the rear side of the glass door leaf.

Figure 2:
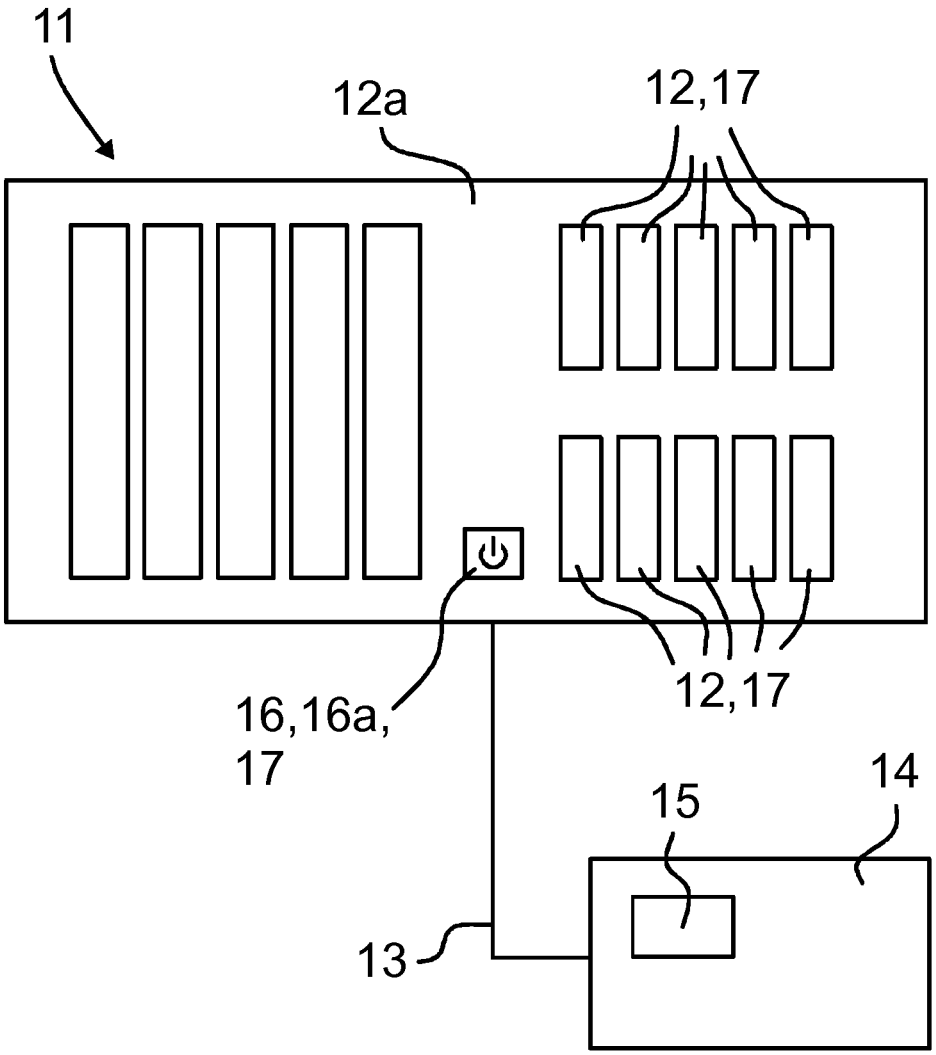
FIG. 2 shows a schematic diagram of a touch screen with at least one input means and an unlocking means.

FIG. 2 shows schematically an example of a view of the input device 11. The input device 11 comprises a number of input means 12, also including the additional input means 16, which input means 12, 16 especially form the touch screen 12*a*, and an electronic control device 14. The electronic control device 14 is designed to control at least one function of the household device 1, especially of the refrigeration device 1*a*. To this end at least one input means 12, 16, especially the touch screen 12*a*, is connected electrically via an electrical connection lead 13 to the electronic control device 14. On manual actuation of the input means 12, of the additional input means 16 or of the touch screen 12*a*, an assigned control signal will be conveyed to the control device 14 via the connecting lead 13.

The input device 11 has the additional input means 16, especially an unlocking means 16*a* to be actuated manually, which is designed and/or intended, when actuated, to put the input means locking device 15 into the unlocked state.

To this extent the input device 11, through the input means 12 and the additional input means 16, especially the unlocking means 16*a*, has a plurality of touch input means 17, which can especially be grouped together in the form of a touch screen 12*a*, to which the number of touch input means 17 are assigned.

The input means locking device 15, as indicated in FIG. 2, can be formed at least substantially by a computer program that is stored in a program memory of the control device 14.

The input means locking device 15 is designed, in its locked state, to suppress an activation of the function of the household device 1 despite actuation of the at least one input means 12 and, in its unlocked state, to allow an activation of the function of the household device 1 on actuation of the at least one input means 12, wherein the input means locking device 15 is designed and/or intended, in the absence of an actuation of the at least one input means 12 over a predetermined period of time, to put the input means locking device 15 into the locked state.

Figure 3:
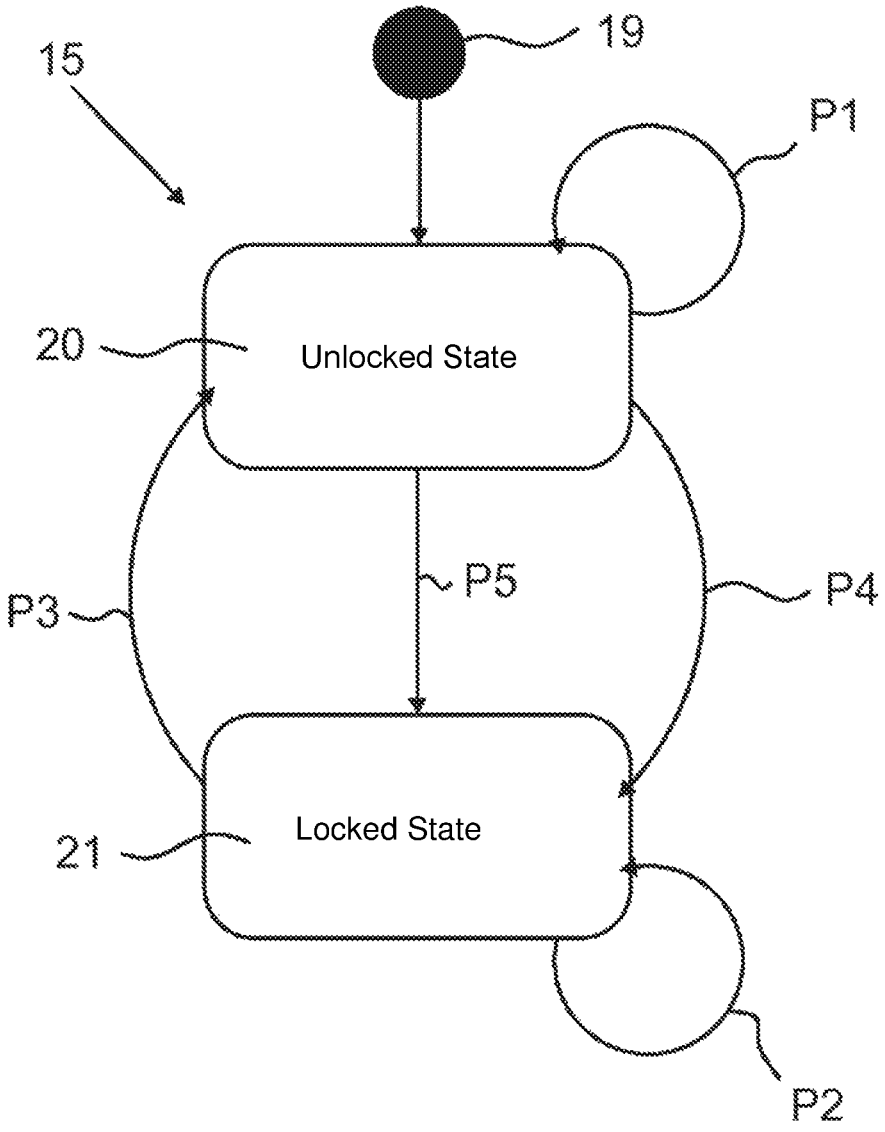
FIG. 3 shows a schematic flow diagram of the method of operation of an inventive input means locking device.

A schematic flow diagram of the method of operation of an example of the input means locking device relating thereto is illustrated in FIG. 3.

The upper status field 20 shown in FIG. 3 represents the unlocked state of the input means locking device 15 and the lower status field 21 represents the locked state of the input means locking device 15. Starting from a switch-on state 19, which can occur through the electrical switching-on of a main switch of the household device 1 or by the connection of the household device 1 to an electrical power socket, the input means locking device 15 initially assumes the unlocked state in accordance with the upper status field 20. In this unlocked state a display means, such as a lamp or an LED, can illuminate and thereby display the unlocked state. Now the household device 1 can be activated, i.e. controlled, by means of the input means 12, 16 on the touch screen 12*a*, in order to control the operation of the household device 1.

Since the input means locking device 15 is designed and/or intended, in the absence of an actuation of the at least one input means 12, 16 over a predetermined period of time, to put the input means locking device 15 into the locked state, after the predetermined period of time has elapsed, the input means locking device 15 assumes the locked state in accordance with the lower status field 21, if none of the input means 12, 16 is actuated within this predetermined period of time. The predetermined period of time can be a period of time of between 10 seconds and 50 seconds for example, especially a period of 30 seconds.

If by contrast, within the ongoing predetermined period of time, one or more of the input means 12, 16 is actuated, the input means locking device 15 does not drop into the locked state in accordance with the lower status field 21, but remains, as indicated by the arrow P1, in the unlocked state in accordance with the upper status field 20.

However if the input means locking device 15 is already in the locked state in accordance with the lower status field 21, then a manual actuation of one of the input means 12 does not at first initiate any unlocking, in order to put the input means locking device 15 into the unlocked state in accordance with the upper status field 20. Instead the input means locking device 15 remains in the locked state in accordance with the lower status field 21, as indicated by the arrow P2, until exclusively the additional input means 16 or the unlocking means 16*a* is continuously actuated for a predetermined minimum period of time, which can amount to between 1 second and 5 seconds, especially around 2 or 3 seconds, and the input means locking device 15, as indicated by the arrow P3, jumps to the unlocked state in accordance with the upper status field 20. Now the household device 1 can be activated, i.e. operated, by means of the input means 12, 16 on the touch screen 12*a* by manual actuation, in order to control the operation of the household device 1.

In the renewed absence of an actuation of the at least one input means 12, 16 over the predetermined period of time, the input means locking device 15 is again put into the locked state in accordance with the lower status field 21, as is indicated by the arrow P4. As a supplement to such an inventive automatic locking of the input device 11, the input device 11 can also be deliberately put into the lower status field 21 immediately by the user, i.e. by active actuation of the additional input means 16, especially of the unlocking means 16*a* to be actuated manually, without having to wait for the predetermined period of time, as is indicated by the arrow P5.

The additional input means 16, especially the unlocking means 16*a* to be actuated manually, can accordingly be designed and/or intended only to put the input means locking device 15 into the unlocked state after an ongoing actuation lasting beyond a minimum period of time.

The control device 14 can also be designed and/or intended, during the ongoing actuation of the additional input means 16, especially of the unlocking means 16*a* to be actuated manually, to output an acoustic and/or optical signal of a first type.

The control device 14 can also be designed and/or intended, after the minimum period of time has elapsed in which there has been an ongoing actuation of the additional input means 16, especially of the unlocking means 16*a* to be actuated manually, to output an acoustic and/or optical signal of a second type that differs from the acoustic and/or optical signal of the first type.

The additional input means 16, especially the unlocking means 16*a* to be actuated manually, can be designed and/or intended, in the unlocked state of the input means locking device 15, to activate another function that differs from the unlocking function.

The control device 14 can also be designed and/or intended, for an actuation of the at least one input means in the locked state of the input means locking device 15, to output an acoustic and/or optical signal of a third type.

The control device 14 can also be designed and/or intended, for an actuation of the at least one input means 12 in the locked state of the input means locking device 15, to output a signal, especially an acoustic and/or optical signal, indicative of the additional input means 6*a*, especially of the unlocking means 16*a* to be actuated manually.

LIST OF REFERENCE CHARACTERS

1 Household device
1*a* Refrigeration device

2 Body
3 Inner container
4 Storage space
5 Shelf
6 Door leaf
7 Door shelf
8*a* Glass front
8*b* Metal front
9 Control panel
10 Window section
11 Input device
12 Input means
12*a* Touch screen
13 Connecting lead
14 Control device
15 Input means locking device
16 Additional input means
16*a* Unlocking means
17 Touch input means
18 Compartment
19 Switch-on state
20 Upper status field
21 Lower status field

The invention claimed is:

1. A household device, comprising:

an electronic controller configured to control at least one function of the household device;

an input control section connected to said electronic controller, said input control section including at least one input and said input control section being configured, based on a manual actuation of said at least one input, to supply an assigned control signal to said electronic controller; and an input lock, in a locked state, being configured to prevent controlling of the function of the household device despite said at least one input being actuated, and in an unlocked state, being configured to permit controlling of the function of the household device when said at least one input is being actuated;

said assigned control signal supplied based on a manual actuation of said at least one input not being a control signal to place said input lock in said locked state;

said input lock being configured and/or constructed to place said input lock into said locked state in an absence of an actuation of said at least one input over a predetermined period of time, and, after placing said input lock into said locked state, said input lock configured and/or constructed to permit all control elements to still be actuated by a user, but the entries of the user no longer lead to a change in device settings defined by the user.

2. The household device according to claim 1, wherein said input control section has an additional input being manually actuable and being at least one of configured or constructed, when actuated, to place said input lock into said unlocked state.

3. The household device according to claim 2, wherein said additional input is an unlocking input.

4. The household device according to claim 2, wherein said manually actuable additional input is at least one of configured or constructed to only put said input lock into said unlocked state after an ongoing actuation beyond a minimum period of time.

5. The household device according to claim 3, wherein said manually actuable unlocking input is at least one of configured or constructed to only put said input lock into said unlocked state after an ongoing actuation beyond a minimum period of time.

6. The household device according to claim 4, wherein said controller is at least one of configured or constructed to be actuated manually to output at least one of an acoustic or optical signal of a first type during an ongoing actuation of said manually actuable additional input.

7. The household device according to claim 5, wherein said controller is at least one of configured or constructed to be actuated manually to output at least one of an acoustic or optical signal of a first type during an ongoing actuation of said manually actuable unlocking input.

8. The household device according to claim 6, wherein said controller is at least one of configured or constructed to output at least one of an acoustic or optical signal of a second type differing from said at least one of an acoustic or optical signal of the first type after an expiration of a minimum period of time having an ongoing actuation of said manually actuable additional input.

9. The household device according to claim 7, wherein said controller is at least one of configured or constructed to output at least one of an acoustic or optical signal of a second type differing from said at least one of an acoustic or optical signal of the first type after an expiration of a minimum period of time having an ongoing actuation of said manually actuable unlocking input.

10. The household device according to claim 2, wherein said manually actuable additional input is at least one of configured or constructed to control a function differing from an unlocking function in said unlocked state of said input lock.

11. The household device according to claim 3, wherein said manually actuable unlocking input is at least one of configured or constructed to control a function differing from an unlocking function in said unlocked state of said input lock.

12. The household device according to claim 8, wherein said controller is at least one of configured or constructed to output at least one of an acoustic or optical signal of a third type when said at least one input is actuated in said locked state of said input lock.

13. The household device according to claim 9, wherein said controller is at least one of configured or constructed to output at least one of an acoustic or optical signal of a third type when said at least one input is actuated in said locked state of said input lock.

14. The household device according to claim 1, wherein said controller is at least one of configured or constructed to output a signal indicative of said manually actuable additional input when said at least one input is actuated in said locked state of said input lock.

15. The household device according to claim 14, wherein said signal is at least one of an acoustic or optical signal.

16. The household device according to claim 1, wherein said controller is at least one of configured or constructed to output a signal indicative of said manually actuable unlocking input when said at least one input is actuated in said locked state of said input lock.

17. The household device according to claim 16, wherein said signal is at least one of an acoustic or optical signal.

18. The household device according to claim 1, wherein said predetermined period of time is between 10 seconds and 50 seconds.

19. The household device according to claim 1, wherein said predetermined period of time is a period of 30 seconds.

20. The household device according to claim 1, wherein said input control section has at least one touch input.

21. The household device according to claim 1, wherein said input control section has a touch screen and at least one touch input associated with said touch screen.

* * * * *